US007497099B2

(12) United States Patent
Shibano

(10) Patent No.: US 7,497,099 B2
(45) Date of Patent: Mar. 3, 2009

(54) ULTRASONIC WASHING METHOD FOR CLOTHES

(75) Inventor: Yoshihide Shibano, Kanagawa (JP)

(73) Assignee: Star Cluster Co., Ltd., Kanagawa (JP)

( * ) Notice: Subject to any disclaimer, the term of this patent is extended or adjusted under 35 U.S.C. 154(b) by 266 days.

(21) Appl. No.: 10/575,006

(22) PCT Filed: Oct. 6, 2003

(86) PCT No.: PCT/JP03/12791

§ 371 (c)(1),
(2), (4) Date: Oct. 26, 2006

(87) PCT Pub. No.: WO2005/033398

PCT Pub. Date: Apr. 14, 2005

(65) Prior Publication Data

US 2007/0136957 A1 Jun. 21, 2007

(51) Int. Cl.
*D06B 5/12* (2006.01)

(52) U.S. Cl. ..... 68/3 SS; 69/9

(58) Field of Classification Search ..... 68/3 SS, 68/9, 10, 11

See application file for complete search history.

(56) References Cited

U.S. PATENT DOCUMENTS

| | | | | |
|---|---|---|---|---|
| 2,097,422 | A * | 10/1937 | Rathjens | 209/437 |
| 3,581,125 | A * | 5/1971 | Arndt et al. | 310/316.01 |
| 3,688,527 | A * | 9/1972 | Stanley | 68/3 SS |
| 4,909,266 | A * | 3/1990 | Massa | 134/60 |
| 5,881,577 | A * | 3/1999 | Sauer et al. | 68/5 R |
| 6,266,836 | B1 * | 7/2001 | Gallego Juarez et al. | 8/151 |

(Continued)

FOREIGN PATENT DOCUMENTS

| | | | |
|---|---|---|---|
| JP | 09-010468 | * | 1/1997 |

(Continued)

*Primary Examiner*—Frankie L Stinson
(74) *Attorney, Agent, or Firm*—Carrier, Blackman & Associates, P.C.; William D. Blackman; Joseph P. Carrier

(57) ABSTRACT

An object of the present invention is to efficiently perform a series of processing including washing in which, for example, different types of clothes or a large volume of clothes etc. are washed and thereafter arranged in order. The clothes etc. are sortably stored in a washing basket (A) for storing the clothes etc. hung on hangers by hanging them vertically, a washing basket (B) for storing the clothes etc. hung on hangers by stacking them horizontally, and a washing basket (C) for storing the clothes etc. by folding them up and stacking them on each other. Pre-processing is performed such that after these washing baskets have beet charged into a pre-processing chamber (1) and the pre-processing chamber (1) has been evacuated to remove gases such as air contained in clearances in the clothes etc., deaerated washing fluid is introduced into the pre-processing chamber (1) to immerse the clothes etc. in the washing fluid. Subsequently, washing processing is performed such that the washing basket is transferred into a washing Ember (2), dissolved gases are removed while the washing fluid is circulated, and at the same time, ultrasonic waves are put out to perform ultrasonic washing Then, post-processing is performed such that after the washing processing has been fished, the washing basket is transferred into a post-processing chamber (3) to rinse the clothes etc. All of the above-described processing is performed automatically.

2 Claims, 7 Drawing Sheets

U.S. PATENT DOCUMENTS 7,264,010 B2 * 9/2007 Husain et al. ..... 134/201

FOREIGN PATENT DOCUMENTS

JP 2000-140479 5/2000
JP 2000-325686 11/2000
JP 2001-120875 5/2001
JP 2003-096659 * 4/2003

* cited by examiner (a)

(b)

(a)

(b)

ULTRASONIC WASHING METHOD FOR CLOTHES

TECHNICAL FIELD

The present invention relates to a technique for performing ultrasonic washing for fibrous substances such as clothes, sheets, towels, and mats.

BACKGROUND ART

Conventionally, as a technique for washing clothes etc., a method in which clothes etc are immersed in a washing fluid and are rotatingly washed as in the case of a washing machine has been used generally. However, a technique for washing clothes etc. by utilizing ultrasonic waves has been known. As such an ultrasonic washing technique, for example, Japanese Patent Application Publication No. 2000-325686 proposed by the applicant of this invention has been known. In this technique, after clothes etc. are put in a ultrasonic washing tank from which a washing fluid has been drawn out, the interior of the washing tank is evacuated to remove air etc. contained in clearances between fibers of the clothes etc., and thereafter ultrasonic washing is performed by introducing deaerated washing fluid into the was tank.

Also, as another ultrasonic washing technique, a technique described, for example, in Japanese Patent Application Publication No. 2001-120875 has been known. In this technique, clothes are moved in a state of being hung from an endless conveying device, and the clothes etc. are immersed in electrolytically reducing ionized water in a washing tank disposed in the movement region before washing is performed by putting out ultrasonic waves.

Further, as still another ultrasonic washing technique, a technique described, for example, in Japanese Patent Application Publication No. 2000-140479 has beet known. In this technique, a washing tank is heated properly to wash clothes etc. while sound waves of extremely low-frequency sound, middle-frequency sound band, ultrasonic waves, etc. are put out.

However, the above-described techniques have a problem in that in the case of rotational washing, intertwining or tangling of clothes etc. occurs, which requires much labor and time in arranging the clothes etc. in order, and at the same time, the clothes etc. are liable to be worn out. Also, in the case of ultrasonic washing technique as well, there is room for improvement in efficiently performing a series of work including washing in which, for example, different types of clothes or a large volume of clothes etc. are washed and thereafter arranged in order.

Accordingly, an object of the present invention is to prevent clothes etc. from being worn out, and to efficiently perform a series of work in which, for example, different types of clothes or a large volume of clothes etc. are washed and thereafter arranged in order.

DISCLOSURE OF THE INVENTION

To achieve the above object, in a washing method for clothes etc. in accordance with the present invention, clothes etc. are stored in a plurality of kinds of washing baskets by being sorted; pre-processing is performed such that gases such as air contained in clearances in the clothes etc, are removed by charging each of the washing baskets into a pre-processing chamber and evacuating the preprocessing chamber, and then deaerated washing fluid is introduced into the pre-processing chamber, washing processing is then performed such that the washing basket in the pre-processing chamber is transferred into a washing chamber, then deaeration is accomplished while the washing fluid in the washing chamber is circulated, and at the same time, ultrasonic washing is performed; and post-processing is then performed such that the washing basket in the washing chamber is transferred into a post-processing chamber to perform draining.

In this manner, the clothes etc. are stored in a plurality of kinds of washing baskets by being sorted, and the washing basket is sent surely into the pre-processing chamber, the washing chamber, and the post-processing chamber to perform pre-processing, washing processing, and post-processing Thereby, a series of work including neat arrangement after washing can be performed efficiently.

As the clothes etc., fibrous substances such as futons, mats, sheets, and roll towels are included in addition to general clothes.

In the ultrasonic washing, the impact force of cavitation can be increased strongly by removing gases dissolved in the washing fluid. For example, the amount of dissolved gases should preferably be 3 mg/liter or smaller. Also, for this purpose as well, it is important to remove gases contained in clearances between fibers of the clothes etc. in the pre-processing chamber.

Also, another washing method in accordance with the present invention is characterized in that the plurality of kinds of washing baskets include at least two kinds of baskets; one kind of basket stores clothes etc. hung on hangers by hanging them vertically, and the other kind of basket stores clothes etc. hung on hangers by stacking them horizontally.

By including the washing basket in which clothes etc. are hung on hangers as described above, a series of work including neat arrangement after washing can be automated easily. Also, in the case where the clothes etc. hung on hangers are hung vertically, foreign matters, such as hair and sand, adhering to the clothes etc. can be removed effectively. It is preferable that clothes such as a shirt, which are less liable to stretch even if the washing fluid is absorbed, be stored by being hung vertically on hangers, and clothes such as menswear, which may be stretched by the weight of water when the washing fluid is absorbed, be stored by being hung on hangers and stacked horizontally.

Also, still another ultrasonic washing method in accordance with the present invention is characterized in that processing performed in the pre-processing chamber, the washing chamber, and the post-processing chamber is performed in an identical batch processing chamber.

Such a batch processing chamber is suitable for small-scale laundries or household in which, for example, small-scale clothes etc. are washed. The identical batch processing chamber is used to perform the pre-processing for removing gases contained in clearances between fibers of the clothes etc., the washing processing for performing ultrasonic washing and the post-processing for performing draining. In this case, as in the above-described example, the washing baskets charged into the batch processing chamber are of three kinds; a basket for storing the clothes etc. hung on hangers by hanging them vertically, a basket for storing the clothes etc. hung on hangers by stacking them horizontally, and a basket for storing the clothes etc. folded up by stacking them on each other. In place of charging of the washing baskets, shafts or bars for hooking hangers, shelves for stacking the clothes etc., and the like may be provided in the batch processing chamber.

BEST MODE FOR CARRYING OUT THE INVENTION

The present invention will now be described in detail with reference to the accompanying drawings.

An ultrasonic washing method for clothes etc. in accordance with the present invention is characterized in that a series of work in which, for example, different types of clothes or a large volume of clothes etc are washed and thereafter arranged in order can be performed efficiently. Specifically, in this ultrasonic washing method, clothes etc. are stored in a plurality of kinds of washing baskets 80 as to be sorted according to the kinds of clothes etc.; first in a pre-processing chamber, pre-processing is performed such that gases such as air contained in clearances between fibers of the clothes etc. are removed by evacuation, and thereafter a washing fluid from which dissolved gases have been removed is introduced; subsequently, in a washing chamber, washing processing is performed such that ultrasonic washing is performed while deaerating the washing fluid; and in a post-processing chamber, post-processing such as draining is performed.

Figure 1:
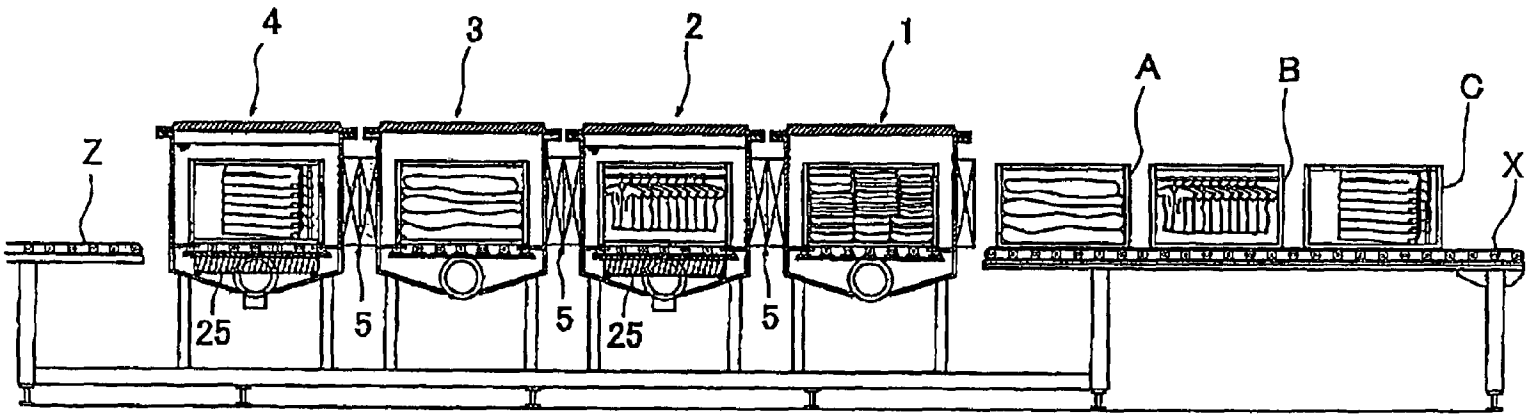
FIG. 1 is a view showing one example of a system configuration in the case where an ultrasonic washing method in accordance with the present invention is carried out on a mass production line.

One example of a system configuration in the case where such an ultrasonic washing method is carried out on a mass production line is shown in FIG. 1. As the several leads of washing baskets, three kinds of washing baskets are used in this example. Specially, three kinds of washing baskets A, B and C for storing clothes etc. are prepared on a feed conveyor X. The washing baskets A, B and C are reticulate baskets made of, for example, plastic. The washing basket A is configured so as to be capable of storing sweaters, knitting, and the like, which are liable to absorb water and to stretch, by being folded up and stacked on each other. The washing basket B is provided with a horizontal shaft capable of hanging many shirts and the like, which are less liable to stretch even if being hung on hangers. The washing basket C is configured so as to be capable of horizontally stacking clothes etc., which may be stretched by the weight of contained water, in a state of being hung on hangers as in the case of the washing basket B, and is provided with a vertical bar for hooking the tip end of a horizontally-directed hanger. Also, at the upper part of each of the washing baskets A, B and C, a lid capable of preventing clothes etc. to be washed from floating is provided.

Also, on the downstream side of the feed conveyor X by which these washing baskets A, B and C are conveyed, a pre-processing chamber 1 for performing pre-processing, a washing chamber 2 for performing washing a post-processing chamber 3 for performing post-processing, and a rinsing chamber 4 for performing rinsing are provided in series via shutter mechanisms 5. The chambers 1, 2, 3 and 4 are configured so that the washing baskets A, B and C can be received one after another and can be delivered to a delivery conveyor Z on the downstream side after the pre-processing, washing, post-processing, and rinsing have been finished.

For this purpose, on both side surfaces of each of the chambers 1, 2, 3 and 4, an inlet portion and an outlet portion capable of allowing the washing baskets A, B and C to pass through are formed. In addition, the shutter mechanism 5 is provided so as to connect the outlet portion of a chamber on the upstream side and the inlet portion of a chamber on the downstream side to each other and shut off them from each other, and in each of the chambers 1, 2, 3 and 4 as well, a transportation path for transferring the washing baskets A, B and C is provided.

Figure 2:
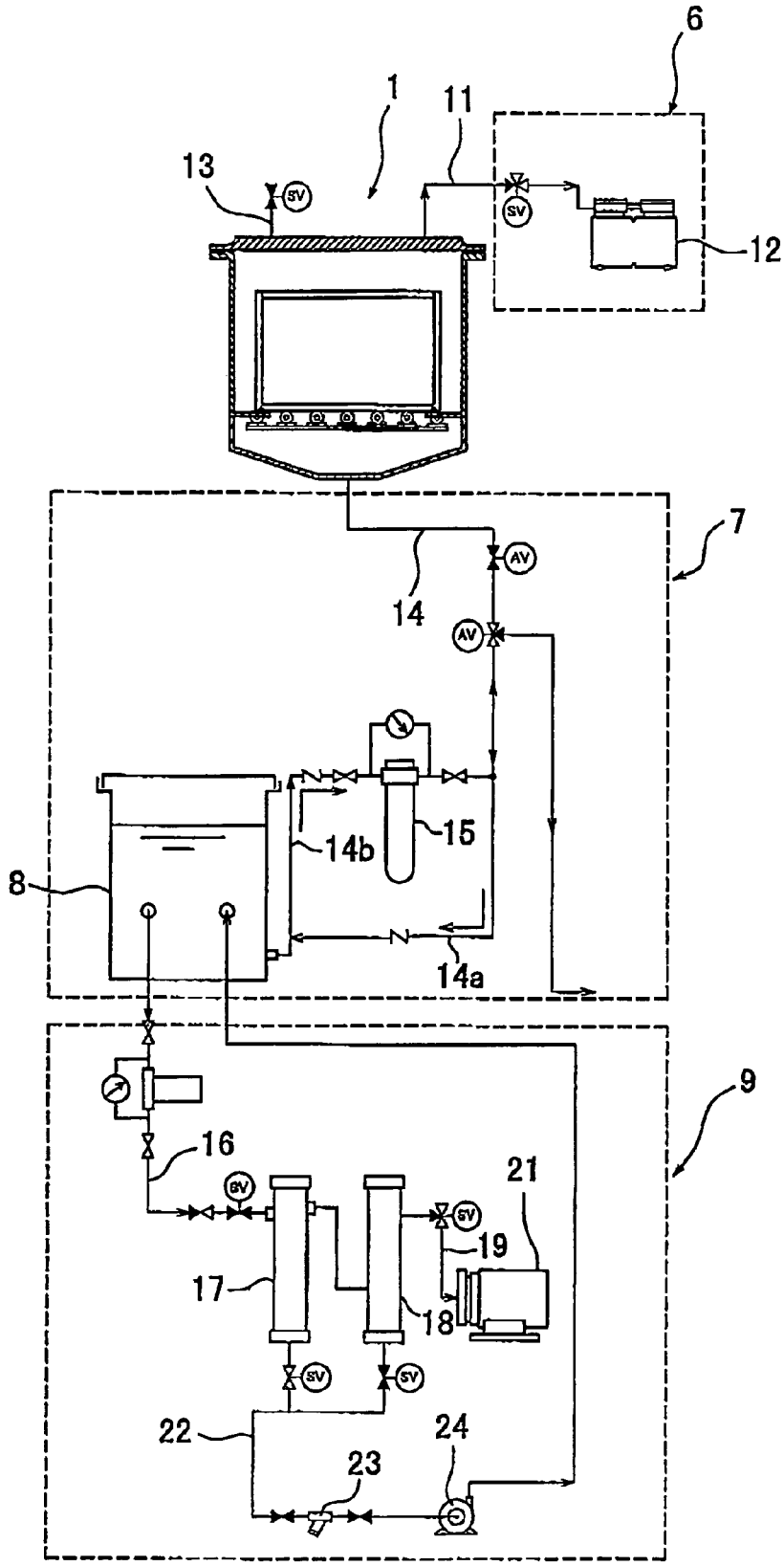
FIG. 2 is a view showing on example of a configuration of circuits connected to a pre-processing chamber.

The pre-processing chamber 1 is configured so as to be capable of removing air etc. contained between fibers of the clothes etc When the washing basket A, B or C enters into the pre-processing chamber 1, the inlet and outlet thereof are closed and the chamber 1 is evacuated in a short period of time. Subsequently, if the vacuum state is confirmed, deaerated washing fluid (water or a washing fluid containing a surface active agent) is introduced. Therefore, as shown in FIG. 2, the pre-processing chamber 1 is connected with an evacuation circuit 6 for evacuating the pre-processing chamber 1 and a lead-in/out circuit 7 for leading the washing fluid into and out of the pre-processing chamber 1. To the other end side of the lead-in/out circuit 7, a storage tank 8 is connected. To this storage tank 8 is connected a deaeration circuit 9 for removing gases contained in the washing fluid.

The evacuation circuit 6 includes a vacuum pump 12 capable of evacuating the pre-processing chamber 1 from the upper part of the pre-processing chamber 1 through a suction line 11. Also, an atmosphere open line 13 for returning the pressure in the pre-processing chamber 1 to the atmospheric pressure is provided adjacently to the suction line 11.

The lead-in/out circuit 7 includes a connection line 14 for connecting the pre-processing chamber 1 to the storage tank 8. At an intermediate position of the connection line 14, a first line 14*a* capable of allowing the washing fluid to flow from the pre-processing chamber 1 side toward the storage tank 8 side and a second line 14*b* capable of allowing the washing fluid to flow from the storage tank 8 side toward the pre-processing chamber 1 side are provided in a branching manner. At an intermediate position of the second line 14*b*, a filter 15 is disposed.

The deaeration circuit 9 is configured so as to be capable of removing gases dissolving in the washing fluid in the storage tank 8. The circuit 9 includes a deaeration cylinder 17 connected to the storage tank 8 via a lead-out line 16, a bubble dissipation cylinder 18 for dissipating bubbles formed in the deaeration cylinder 17, and a vacuum pump 21 connected to the bubble dissipation cylinder 18 via an evacuation line 19. To the lower end parts of the deaeration cylinder 17 and the bubble dissipation cylinder 18, one end side of a circulation line 22 is connected, and also the other end side of the circulation line 22 is connected to the storage tank 8. At an intermediate position of the circulation line 22, a strainer 23 and a circulation pump 24 are disposed.

A line that connects the deaeration cylinder 17 to the bubble dissipation cylinder 18 is connected so that a portion near the upper part of the deaeration cylinder 17 and a portion near the lower part of the bubble dissipation cylinder 18 are connected to each other to suck bubbles formed in the deaeration cylinder 17. The bubble dissipation cylinder 17 incorporates a heating unit such as a heater so that when bubbles come in contact with the heating unit, the bubbles are dissipated, and thus the washing fluid accumulating at the lower part due to bubble dissipation is returned to the storage tank 8 through the circulation line 22. Also, the evacuation line 19 connected to the bubble dissipation cylinder 18 is connected to the upper part side of the bubble dissipation cylinder 18, so that the washing fluid is prevented from intruding into the vacuum pump 21. At this time, a trap for capturing the washing fluid may be provided at an intermediate position of the evacuation line 19 as necessary.

Also, the configuration is made such that when the vacuum pump 21 connected to the bubble dissipation cylinder 18 is operated, the internal pressures of the deaeration cylinder 17 and the bubble dissipation cylinder 18 can be decreased to minus 500 mmHg or lower.

Figure 3:
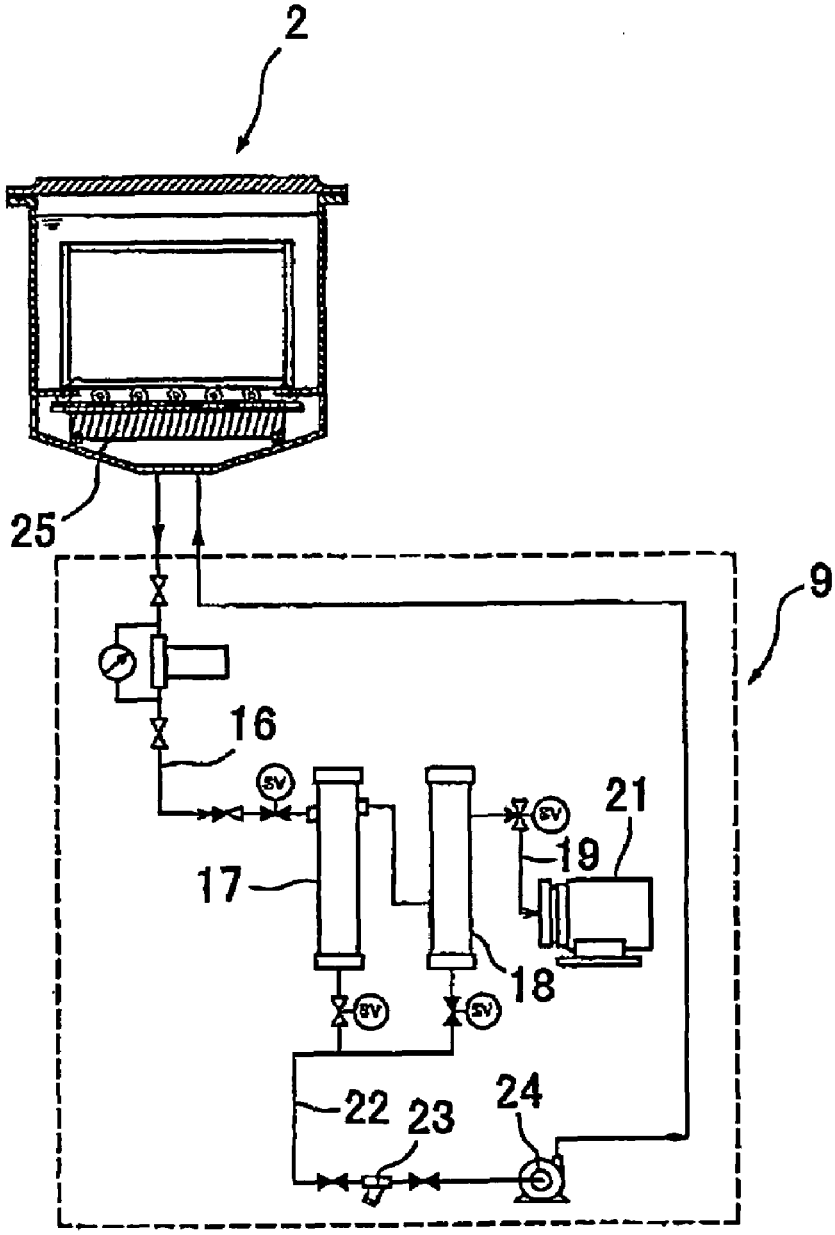
FIG. 3 is a view showing one example of a configuration of circuit connected to a washing chamber.

As shown in FIG. 3, the washing chamber 2 has a washing fluid (water or a washing fluid containing a surface active agent) and an ultrasonic vibrator 25. Also, the washing chamber 2 is connected with the deaeration circuit 9 for removing gases dissolving in the washing fluid in the chamber. This deaeration circuit 9 has a configuration that is almost the same as that of the deaeration circuit 9 connected to the storage tank 8. Specifically, the deaeration circuit 9 is adapted to feed the washing fluid drawn out of the washing chamber 2 through the lead-out line 16 into the deaeration cylinder 17 to remove dissolved gases, to return the deaerated washing fluid to the washing chamber 2 through the circulation line 22, and to send the bubbles formed in the deaeration cylinder 17 into the bubble dissipation cylinder 18 to dissipate the bubbles.

This deaeration circuit 9 may be in common with the deaeration circuit 9 for the pre-processing chamber 1, or may be an independent deaeration circuit separate from the deaeration circuit 9 for the pre-processing chamber 1.

Also, the washing chamber 2 is provided with a fluid level control means, not shown, for keeping the fluid level constant and a detergency meter for monitoring the intensity, state, etc. of ultrasonic waves. Also, the ultrasonic vibrator 25 is usually provided in a bottom part of the washing chamber 2; however, it may be provided on a side surface or both side surfaces as necessary.

The post-processing chamber 3 is configured so as to be capable of preventing the washing fluid from entering into the rinsing chamber 4 on the downstream side. Specifically, the post-processing chamber 3 is provided with a drainage line 33 (FIG. 4) that can recover the washing fluid rapidly when the washing basket A, B or C is introduced, and the drainage line 33 is connected to the storage tank 8, not shown. The washing fluid may be recovered into the storage tank 8 for the pre-processing chamber 1, or may be recovered into a separate storage tank.

Figure 4:
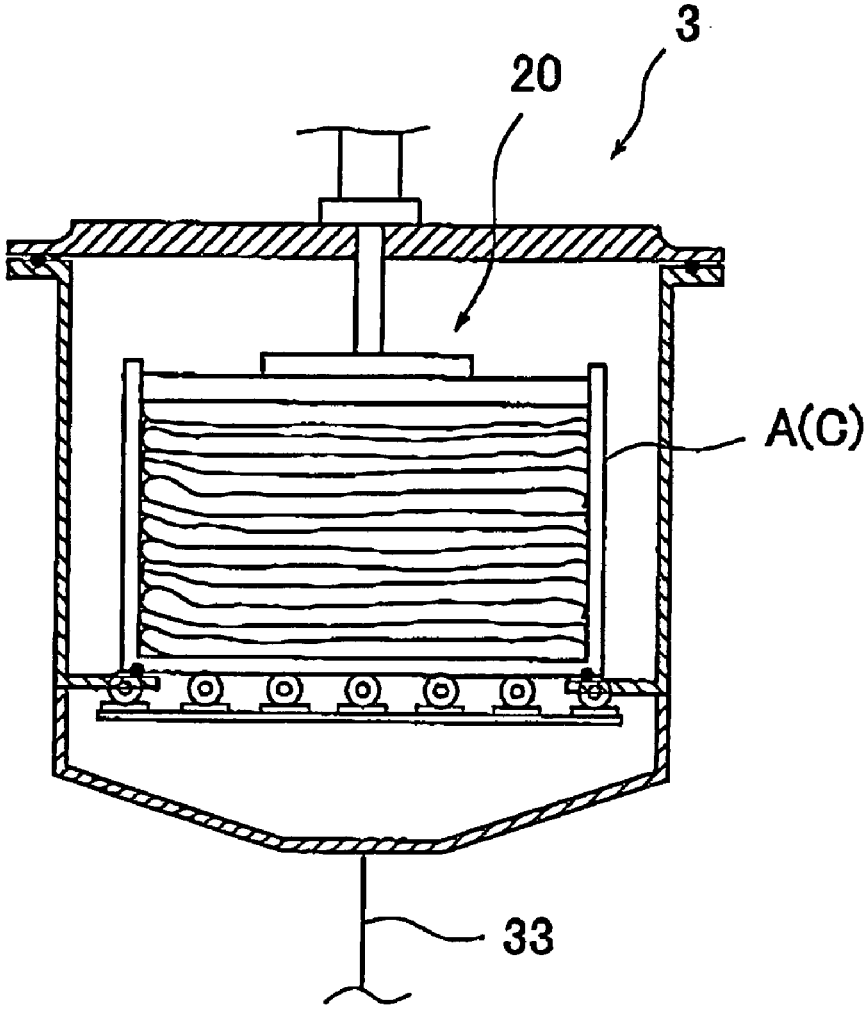
FIG. 4 is a view showing one example of a draining mechanism of a post-processing chamber.

In the case of the washing baskets A and C, as shown in FIG. 4, draining may be performed by applying a compressive load to the clothes etc. by using a cylinder pressing type draining mechanism 20.

Figure 5:
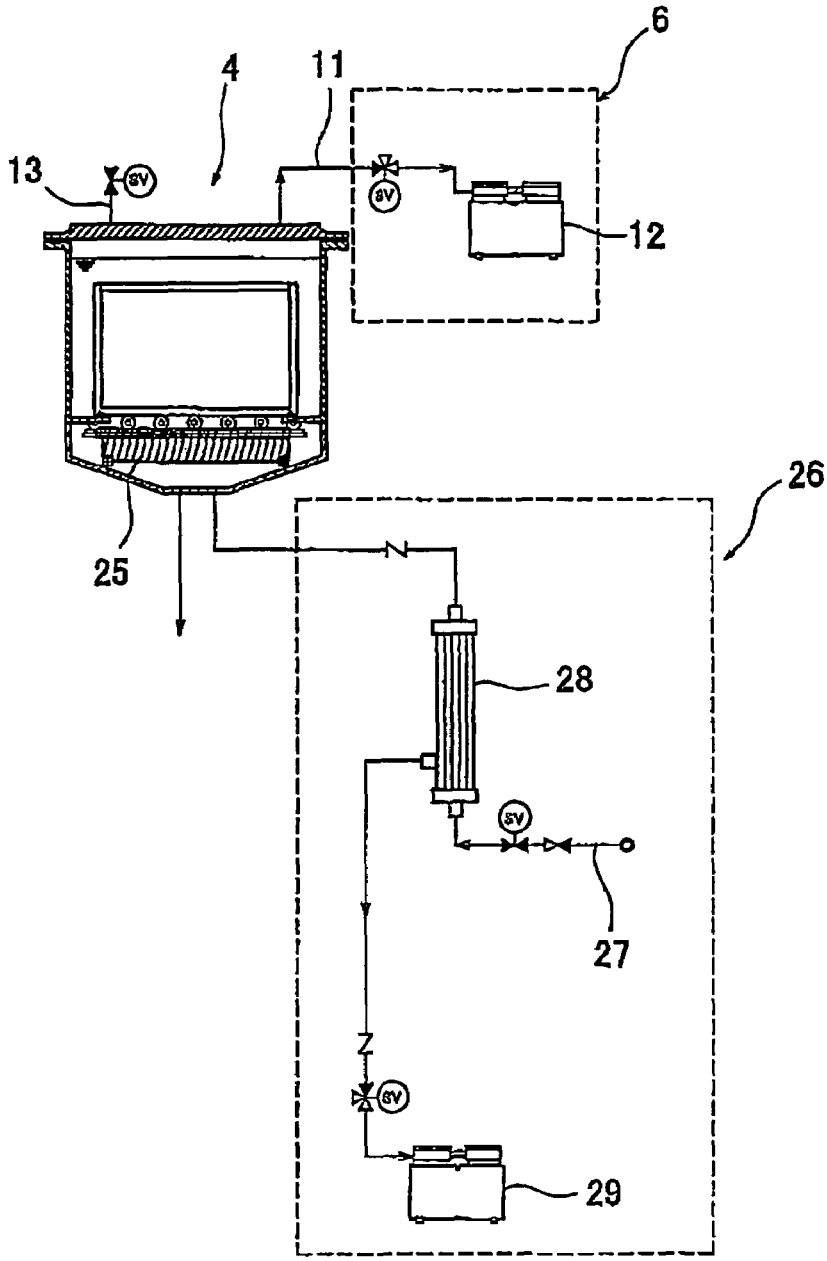
FIG. 5 is a view showing one example of a configuration of circuits connected to a rinsing chamber.

As shown in FIG. 5, the rinsing chamber 4 is provided with the ultrasonic vibrator 25 in the chamber 4. Also, the chamber 4 is connected with a rinse circuit 26 and the evacuation circuit 6. This rinsing circuit 26 is configured so as to be capable of supplying deaerated city water into the chamber 4 through a city water supply line 27, and at au intermediate position of the city water supply line 27, a hollow yarn deaeration module 28 for removing dissolved gases is disposed. This hollow yarn deaeration module 28 is connected with a vacuum pump 29 for evacuation. The configuration is made such that by opening the valve of the city water supply line 27 and by operating the vacuum pump 29, deaeration is accomplished by the hollow yarn deaeration module 28, and deaerated city water can be sent into the chamber 4.

Also, the configuration of the evacuation circuit 6 is the same as that of the evacuation circuit 6 for the processing chamber 1. Specifically, this evacuation circuit 6 includes the vacuum pump 12 capable of evacuating the rinsing chamber 4 from the upper part of the rinsing chamber 4 through the suction line 11, and the atmosphere open line 13 for returning the pressure in the rinsing chamber 4 to the atmospheric pressure.

Figure 6:
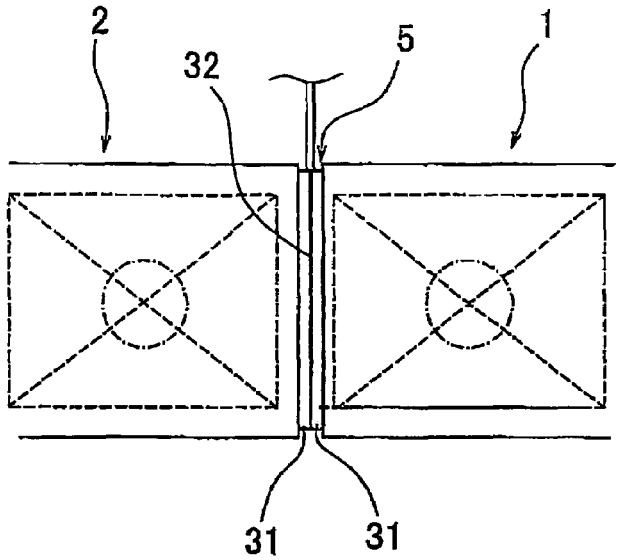
FIG. 6 is a view showing one example of a shutter construction at the boundary of the chambers.
Figure 6:
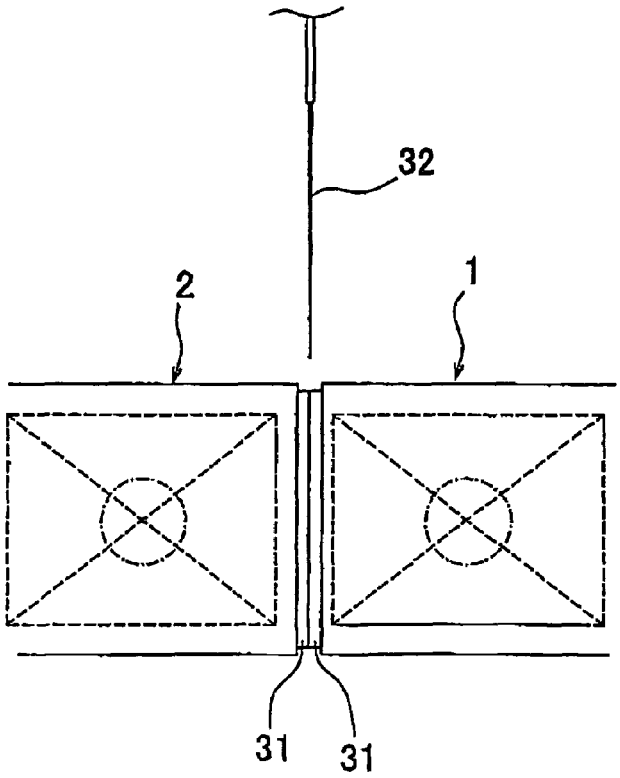

As shown in FIG. 6, each of the shutter mechanisms 5 provided between the chambers 1, 2,3 and 4 includes packing members 31, for example, made of rubber, which are provided on the outside of the inlet portion and the outlet portion of the chambers 1, 2, 3 and 4 and each have a through hole capable of allowing the washing baskets A, B and C to pass through, and a shield member 32 freely insertable between the adjacent packing members 31. The construction is such that when the shield member 32 is inserted between the packing members 31 as shown in FIG. 6(*a*), the flow of the washing baskets A, B and C is inhibited, and when the shield member 31 is separated from the packing member 31 as shown in FIG. 6(*b*), the washing baskets A, B and C are allowed to flow, but the packing members 31 adheres closely to each other so as to prevent the washing fluid from leaking to the outside.

A washing method for clothes etc. carried out by using the above-described system configuration is explained.

First, clothes etc. are sorted properly according to the kind thereof, and are stored in the washing baskets A, B and C. One example of this sorting operation is as described below. As described before, sweaters etc. that are liable to absorb water and to stretch are stored stackedly in the washing basket A, shirts etc. that are allowed to be hung on hangers are stored in the washing basket B, and menswear etc. that are liable to stretch when being hung on hangers are stored in the washing basket C.

Next, the washing basket A, B or C is charged into the pre-processing chamber 1 to undergo pre-processing. When the washing basket A, B or C is charged, the washing fluid in the pre-processing chamber 1 shown in FIG. 2 is transferred into the storage tank 8 and therefore the pre-processing chamber 1 is in an empty state. When the washing basket A, B or C is charged and the chamber 1 is closed, the chamber 1 is evacuated by the evacuation circuit 6, and hence air contained between fibers of the clothes etc. is removed. If the vacuum state is confirmed, the washing fluid in the storage tank 8 is introduced into the chamber 1 through the lead-in/out circuit 7. Since the chamber 1 has a negative pressure, the washing fluid flows automatically into the chamber 1 merely by operating the valve of the lead-in/out circuit 7. This washing fluid has been deaerated in advance by the deaeration circuit 9, and the amount of gases dissolved in the washing fluid is at a level of, for example, 2 mg/liter or smaller in the case of this example. When the clothes etc. have been immersed sufficiently, the valve of the atmosphere open line 13 is opened to return the pressure in the chamber 1 to the atmospheric pressure.

Subsequently, the washing basket A, B or C in the pre-processing chamber 1 is transferred into the washing chamber 2 in a state in which the washing basket A, B or C sinks in the washing fluid. Specifically, the shield member 32 (FIG. 6) between the chambers 1 and 2 is separated from the packing members 31, and after the washing basket A, B or C has been moved into the washing chamber 2, the shield member 32 is again inserted between the packing members 31, by which the chambers 1 and 2 are shut off from each other. Therefore, the washing basket A, B or C is transferred without going out of the fluid. At this time, the fluid levels of the pre-processing chamber 1 and the washing chamber 2 are controlled so as to have the same height. In the pre-processing chamber 1 from which the washing basket A, B or C has bee sent out, preparations for receiving the next washing basket A, B or C are made. The pre-processing chamber 1 repeats the above-described operations.

Next, in the washing chamber 2, after the washing basket A, B or C has been received, ultrasonic was is performed. Specifically, as shown in FIG. 3, dissolved gases are removed (the amount of dissolved gases is 2 mg/liter or smaller) while the washing fluid is circulated by the deaeration circuit 9, and at the same time, the ultrasonic vibrator 25 is operated to put out ultrasonic waves. Thereby, the clothes etc. are washed while being folded up or being hung on hangers. Therefore, the clothes etc. are not jostled until the conventional rotational washing, and moreover are washed far more cleanly than the case where the conventional rotational washing is performed. Also, even if, for example, about 1000 cycles of washing are performed, the fibers of the clothes etc. are scarcely worn out.

After the washing processing has been finished, the washing basket A, B or C is transferred into the post-processing chamber 3. The operation of the shutter mechanism 5 between the chambers 2 and 3 is the same as described above. Specifically, the shield member 32 (FIG. 6) between the chambers 2 and 3 is separated from the packing members 31, and after the washing basket A, B or C has been moved into the post-processing chamber 3, the shield member 32 is again inserted between the packing members 31 to shut off the chambers 2 and 3 from each other.

From the washing basket A, B or C having been sent into the post-processing chamber 3, the washing fluid contained in the clothes etc. are recovered rapidly. At this time, in the case of the washing basket A and C, draining is performed efficiently by compressing the clothes etc. by using the cylinder pressing type draining mechanism 20.

After the draining operation has been finished, the washing basket A, B or C is transferred into the next rinsing chamber 4. The operation of the shutter mechanism 5 between the chambers 3 and 4, which is performed for this transfer, is the same as the operation as described above. After the washing basket A, B or C has been sent into the rinsing chamber 4, as shown in FIG. 5, air having intruded into the chamber 4 temporarily is removed by the evacuation circuit 6, and thereafter city water from which dissolved gases have been removed is introduced by the rinsing circuit 26 to a predetermined fluid level. Subsequently, the ultrasonic vibrator 25 is operated to put out ultrasonic waves, by which ultrasonic rinsing processing is performed. At this time, the evacuation processing is not performed sometimes in the rising chamber 4. In this case, after the washing basket A, B or C has been sent into the rinsing chamber 4, city water from which dissolved gases have been removed is introduced directly by the rinsing circuit 26, by which ultrasonic rinsing is performed.

After the above-described processing has been finished, the washing basket A, B or C is delivered onto the delivery conveyor Z on the downstream side, and finish processing is performed after drying processing. At this time, since the clothes etc. are in a state of being arranged in order by hangers or the like in advance, intertwining or tangling of clothes etc. does not occur, so that the clothes etc. can be arranged in order efficiently. Also, stains that cannot be removed by dry cleaning etc. can also be removed by this ultrasonic washing method.

Also, in the case where the clothes etc. hung on hangers are hung vertically, foreign matters, such as hair and sand, adhering to the clothes etc. can be removed easily.

All of the above-described processing is performed automatically.

Figure 7:
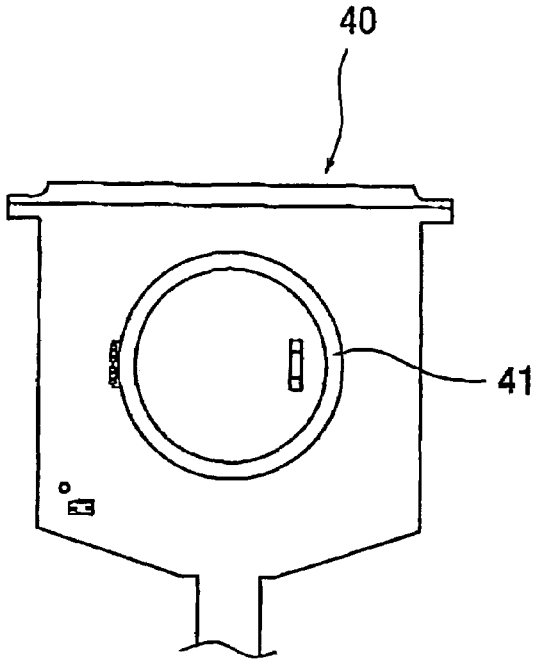
FIG. 7 is an explanatory view showing one example of a batch processing chamber for carrying out an ultrasonic washing method in accordance with the present invention in a batch mode, FIG. 7(*a*) showing a state in which a door is closed, and FIG. 7(*b*) showing a state in which the door is open.
Figure 7:
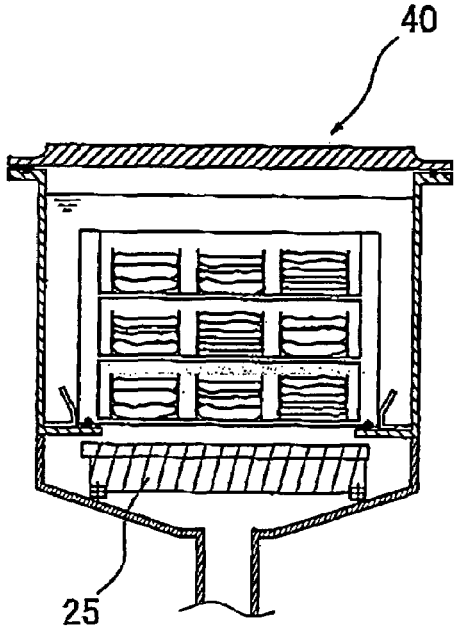

Next, a washing method of a batch mode, which is a miniature of the above-described washing method of a mass production line type, is explained with reference to FIG. 7.

In this washing method, all processes are performed by a single batch processing chamber 40. This batch processing chamber 40 is provided, in the chamber, with horizontal shafts, not shown, for hanging clothes etc. hung on hangers, vertical bars, not shown, for hooking the tip end of a horizontally-directed hanger, and multiple-tier reticulate shelves for stacking clothes etc. Also, a door 41 in the front surface of the chamber 40 is provided with a seal member such as a packing, a sight glass, and the like. Also, this chamber 40 is connected with the ultrasonic vibrator 25, the evacuation circuit 6 for evacuating the chamber 40, the lead-in/out circuit 7 for leading the washing fluid into and out of the chamber 40, the deaeration circuit 9 for removing gases from the washing fluid, and the like, which are the same as described above.

The processing procedure in this batch processing chamber 40 is as described below. After the door 41 has been opened and clothes etc. stored in baskets made of, for example, SUS etc. have been placed on the shelves, the chamber 40 is evacuated to form an evacuated state. After air contained in clearances between fibers has been removed, deaerated washing fluid is introduced. Deaeration and filtration are accomplished while the washing fluid is circulated, and at the same time, the ultrasonic vibrator 25 is operated to perform ultrasonic washing. After the washing processing has been finished, the washing fluid is recovered into the storage tank. Thereafter, the chamber 40 is evacuated to remove air having intruded temporarily, and then city water from which dissolved gases have been removed is introduced to perform ultrasonic ring. Subsequently, the water is drained. The rinsing processing is repeated as necessary, and after the rinsing processing has been finished, the clothes etc. are taken out of the chamber 40.

In this case as we, intertwining or tangling of clothes does not occur, and moreover fibers can be prevented from being worn out as compared with the case of rotational washing. In addition, the processing can be performed in a short period of time, and stains that cannot be removed by dry cleaning etc. can also be removed by this ultrasonic washing method.

Although three kinds of washing baskets A, B and C are used in the above-described examples, other types of washing baskets may be used as necessary.

INDUSTRIAL APPLICABILITY

As described above, in the ultrasonic washing method for clothes etc. in accordance with the present invention, clothes etc. are stored in a plurality of kinds of baskets by being sorted, and air contained in clearances between fibers is removed by pre-processing. Thereafter, the washing fluid from which dissolved gases have been remove is introduced to perform ultrasonic washing, and draining is performed in post-processing. Therefore, intertwining or tangling of clothes etc. does not occur, and at the same time, a series of processing including washing can be performed efficiently in a short period of time.

Also, as the plurality of kinds of washing baskets, at least two kinds of baskets are included; one kind of basket stores clothes etc. hung on hangers by hanging them vertically, and the other kind of basket stores clothes etc. hung on hangers by stacking them horizontally. Thereby, a series of processing including neat arrangement after washing can be automated easily.

The invention claimed is:

1. An ultrasonic washing method for clothes etc., said method comprising the steps of:

storing clothes etc. in a plurality of kinds of washing baskets by being sorted; removing gases such as air contained in clearances in the clothes etc. by charging each of the washing baskets into a pre-processing chamber through an inlet portion in a side surface of the pre-processing chamber and evacuating the pre-processing chamber, and then introducing deaerated washing fluid into the pre-processing chamber;

transferring the washing basket in the pre-processing chamber into a washing chamber through an outlet portion in a side surface of the pre-processing chamber, a shutter mechanism, and an inlet portion in a side surface of the washing chamber;

then accomplishing deaeration while the washing fluid in the washing chamber is circulated, and at the same time, performing ultrasonic washing; and transferring the washing basket in the washing chamber into a post-processing chamber through an outlet portion in a side surface of the washing chamber, a shutter mechanism, and an inlet portion in a side surface of the post-processing chamber to perform draining, characterized in that each of the shutter mechanisms is provided with a packing member and a shield member, which are capable of allowing the washing basket to pass through while shutting off the flow of washing fluid and air.

2. The ultrasonic washing method for clothes etc. according to claim 1, characterized in that the plurality of kinds of washing baskets include at least two kinds of baskets; one kind of basket stores clothes etc. hung on hangers by hanging the clothes etc. vertically, and the other kind of basket stores clothes etc. hung on hangers by stacking the clothes etc. horizontally.

* * * * *

UNITED STATES PATENT AND TRADEMARK OFFICE

CERTIFICATE OF CORRECTION

PATENT NO. : 7,497,099 B2
APPLICATION NO. : 10/575006
DATED : March 3, 2009
INVENTOR(S) : Shibano It is certified that error appears in the above-identified patent and that said Letters Patent is hereby corrected as shown below:

Title page:

In section (56), References Cited, further under "U.S. PATENT DOCUMENTS", on the line for reference number 3,688,527, change "Stanley" to --Blustain--.

After "*Primary Examiner–*", change "Frankie L Stinson" to --Frankie L. Stinson--.

In section (57), ABSTRACT,

11th line, change "have beet charged" to --have been charged--;
18th line, change "washing Ember" to --washing chamber--;
20th line, change "washing Then," to --washing. Then,--;
22nd line, change "has been fished" to --has been finished--.

Column 1:

Line 13, change "clothes etc are" to --clothes etc. are--.
Line 25, change "the was tank." to --the washing tank.--.
Line 36, change "has beet known." to --has been known.--.

Column 2:

Line 11, change "sent surely" to --sent successively--.
Line 14, change "work including neat" to --work, including neat--.
Line 15, change "washing can be" to --washing, can be--.
Line 18, change "included in addition" to --included, in addition--.
Line 28, change "method in accordance" to --method, in accordance--.
Line 29, change "present invention is" to --present invention, is--.
Line 41, change "clothes such as" to --clothes, such as--.
Line 48, change "method in accor-" to --method, in accor- --.
Line 49, change "invention is characterized" to --invention, is characterized--.
Line 59, change "ultrasonic washing and" to --ultrasonic washing, and--.

Column 3:

Line 1, change "and the like may" to --and the like, may--.
Line 13, change "circuit connected to" to --circuits connected to--.
Line 32, change "etc. in accor-" to --etc., in accor- --.
Line 33, change "invention is characterized" to --invention, is characterized--.
Line 35, change "clothes etc are" to --clothes etc., are--.
Line 36, change "arranged in order can" to --arranged in order, can--.
Line 38, change "baskets 80 as to be" to --baskets so as to be--.
Line 51, change "several leads of" to --several kinds of--.
Line 53, change "Specially, three kinds" to --Specifically, three kinds--.

UNITED STATES PATENT AND TRADEMARK OFFICE

CERTIFICATE OF CORRECTION

PATENT NO. : 7,497,099 B2
APPLICATION NO. : 10/575006
DATED : March 3, 2009
INVENTOR(S) : Shibano It is certified that error appears in the above-identified patent and that said Letters Patent is hereby corrected as shown below:

Column 4:
Line 7, change “performing washing a” to --performing washing, a--.
Line 9, change “performing rinsing are” to --performing rinsing, are--.
Line 21, change “shut off them” to --shut them off--.
Line 27, change “clothes etc When” to --clothes etc. When--.

Column 5:
Line 44, after “fluid level constant” insert a comma.
Line 48, change “surface or both side surfaces as” to --surface, or both side surfaces, as--.

Column 6:
Line 2, change “and at au” to --and at an--.
Line 12, change “for the processing” to --for the pre-processing--.
Line 32, change “members 31 adheres” to --members 31 adhere--.
Line 51, change “and therefore the” to --and, therefore, the--.

Column 7:
Line 14, change “has bee sent” to --has been sent--.
Line 19, change “ultrasonic was is” to --ultrasonic washing is--.
Line 26, change “jostled until the” to --jostled, unlike the--.
Line 43, change “are recovered” to --is recovered--.

UNITED STATES PATENT AND TRADEMARK OFFICE

CERTIFICATE OF CORRECTION

PATENT NO. : 7,497,099 B2
APPLICATION NO. : 10/575006
DATED : March 3, 2009
INVENTOR(S) : Shibano It is certified that error appears in the above-identified patent and that said Letters Patent is hereby corrected as shown below:

Column 8:

Line 2, change "in order by hangers" to --in order, by hangers--.
Line 44, change "ultrasonic ring." to --ultrasonic rinsing.--.
Line 48, change "In this case as we," to --In this case as well,--.
Line 65, change "gases have been remove" to --gases have been removed--.

Signed and Sealed this

Thirtieth Day of June, 2009

JOHN DOLL
*Acting Director of the United States Patent and Trademark Office*